US005477019A

United States Patent [19]

Dolling

[11] Patent Number: 5,477,019

[45] Date of Patent: Dec. 19, 1995

[54] STABILIZER DISCONNECT SWITCH FOR ELECTRICAL APPLICANCES

[75] Inventor: Klaus Dolling, Munnerstadt, Germany

[73] Assignee: Thermostat- Und Schaltgeratebau GmbH & Co. KG, Bad Kissingen, Germany

[21] Appl. No.: 295,244

[22] Filed: Aug. 24, 1994

[30] Foreign Application Priority Data

Aug. 25, 1993 [DE] Germany ..... 43 28 542.2

[51] Int. Cl.[6] ..... H01H 35/14

[52] U.S. Cl. ..... 200/61.48; 200/61.52

[58] Field of Search ..... 200/61.45 R–61.53, 200/61.45 M, DIG. 29

[56] References Cited

U.S. PATENT DOCUMENTS

| | | | |
|---|---|---|---|
| 2,428,029 | 9/1947 | Katcher | 200/61.48 X |
| 2,806,916 | 9/1957 | Gibble | 200/61.5 X |
| 3,644,921 | 2/1972 | Duggan et al. | 200/61.5 |
| 3,703,617 | 11/1972 | Burnett | 200/61.5 |
| 3,745,277 | 7/1973 | Shawcross et al. | 200/61.5 |
| 3,797,603 | 3/1974 | Loomba | 200/61.45 R X |
| 3,814,875 | 6/1974 | Takada | 200/61.48 |
| 4,185,507 | 1/1980 | Domyan | 200/61.45 R X |
| 4,314,120 | 2/1982 | Sharp et al. | 200/61.45 R |
| 4,618,746 | 10/1986 | Schwob et al. | 200/61.45 R |
| 5,038,006 | 8/1991 | Lowe, Sr. et al. | 200/61.5 |

FOREIGN PATENT DOCUMENTS

| | | | |
|---|---|---|---|
| 1423356 | 2/1976 | United Kingdom | 200/61.5 |

*Primary Examiner*—J. R. Scott

*Attorney, Agent, or Firm*—Robin, Blecker, Daley & Driscoll

[57] ABSTRACT

A stabilized disconnection switch including a switching device, a housing, a control ball movably supported in the housing to control the switching device, a shell hangably supported by the housing opposite the switching device and noncontiguously circumscribing the control ball in a rest position of the stabilized disconnection switch, whereby, during a tilting motion of the housing, a sudden, complete switching of the switching device occurs upon movement of the shell upon contact of the control ball with the shell.

12 Claims, 2 Drawing Sheets

STABILIZER DISCONNECT SWITCH FOR ELECTRICAL APPLICANCES

FIELD OF THE INVENTION

The invention relates generally to electrical appliances, such as electrical heating devices, and pertains more particularly to a stabilizer for switches interrupting the supply of power to the appliances.

BACKGROUND OF THE INVENTION

Electrical appliances, such as electrical heating devices, are known to include a switching device in the circuit of the appliances, which, upon assuming a tilting position with an inadmissible angle of tilt, separates the electrical arrangement of the appliances from the source of power and upon returning the appliances to the admissible upright working position switches them on to the source of power.

Swiss patent specification CH 620047 shows a disconnection switch arranged in the circuit of a heating appliance which serves as stabilizer and displays a switch casing with a fixed contact and a switch spring that is deflected upon the housing inclining from the vertical, and which interrupts an electric circuit. The switch spring is connected by way of a tappet pin to a plate-shaped body freely supported in the switch casing, which plate is tiltable by a suspended weight.

Although the disconnection switch described above causes a disconnection of the circuit of a heating appliance upon deviation from the vertical operating position, it is at the same time characterized by severe wear of the electrical contact elements. Such wear and tear is explainable particularly by the fact that the contacts are continually opened from their closed position by the tilting of the plate-shaped body that is connected to the tappet pin. Thus, with small aperture distances of the contact elements, electric flashovers occur, which lead to spark erosion and hence to a deficient contact of the contact surfaces. All in all, the life of such disconnection switches is thereby severely limited.

Another stabilizer is known from German design patent DE GM 85 15 854. There, the tilt-sensitive switching device consists of a dish-shaped tipping element which is movably supported within a casing. The dish-shaped tipping element serves particularly to hold a control ball. As soon as the stabilizer reaches a certain angle of tilt, the ball, which is stably positioned in a central boring in the dish-shaped tipping element, leaves its position and rolls to a certain extent in the direction of the edge of the dish. The tipping element tilts under the weight of the ball, thereby simultaneously opening an electrical contact which is in connection with the tipping element.

Here, too, the problems already described above occur again, since, while rolling in the dish, the ball assumes an indifferent state of equilibrium, which can result in a slight rolling to-and-fro of the ball, so that a continuous opening and closing of the electrical contacts is brought about. This leads to the mentioned wear of the contacts. In addition, the device in question with a tilting pan is of relatively complicated design.

In summary, it can be stated that the mentioned problems with known stabilizers are due particularly to the fact that the switching devices consisting of pendulum or roller weights are in direct operative connection to the electrical circuit element, so that each of their movements is transferred directly to the circuit element.

SUMMARY OF THE INVENTION

The present invention has as its primary object the provision of a stabilizer for electrical appliances which overcomes the above-noted difficulties.

In attaining this and other objects, the invention provides, in a stabilizer with a housing, at least one switching device, a control ball movably arranged in the housing to control the switching device, a shell arranged to hang opposite the switching device, with the jacket of the shell in the rest position embracing the control ball at a distance, so that upon a tilting motion of the housing a sudden, complete switching of the switching device is assured.

The foregoing and other objects and features of the invention will be further understood from the following detailed description of a preferred embodiment thereof and from the drawings wherein like reference numerals identify like parts throughout.

DETAILED DESCRIPTION OF PREFERRED EMBODIMENTS AND PRACTICES

Figure 1:
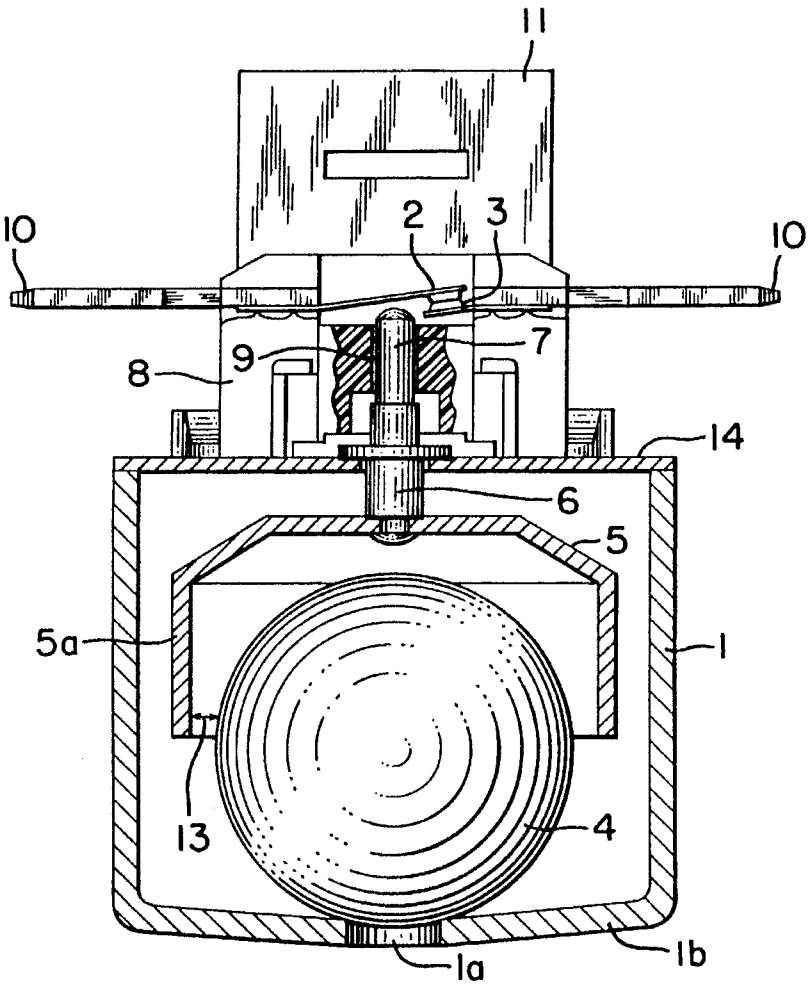
FIG. 1 shows a sectional side elevation of a stabilizer according to the invention, in the rest position.

Referring to FIG. 1, the stabilizer comprises a housing 1 with an outwardly arched housing bottom lb which comprises a central boring la. In the housing, a control ball 4 rests in the boring la in a stable equilibrium position. Above the control ball 4, a hanging shell 5 is provided, which with its shell jacket 5*a* embraces the control ball 4 at a distance 13 from the surface of the ball.

The shell 5 is firmly connected to a control piston 6 which with a cylindrical section extends through a boring in a housing cover 14 and with an inner piston surface of an additional piston section arranged on the control piston rests on the housing cover 14. Above the control piston 4, a cylindrical pin 7 is situated in a guide boring 9, linearly movable in a cover mount 8. Above the cylindrical pin 7, two contact springs 2 and 3 are arranged adjoining one another in the rest position, from which connecting springs 10 extend laterally.

Figure 4:
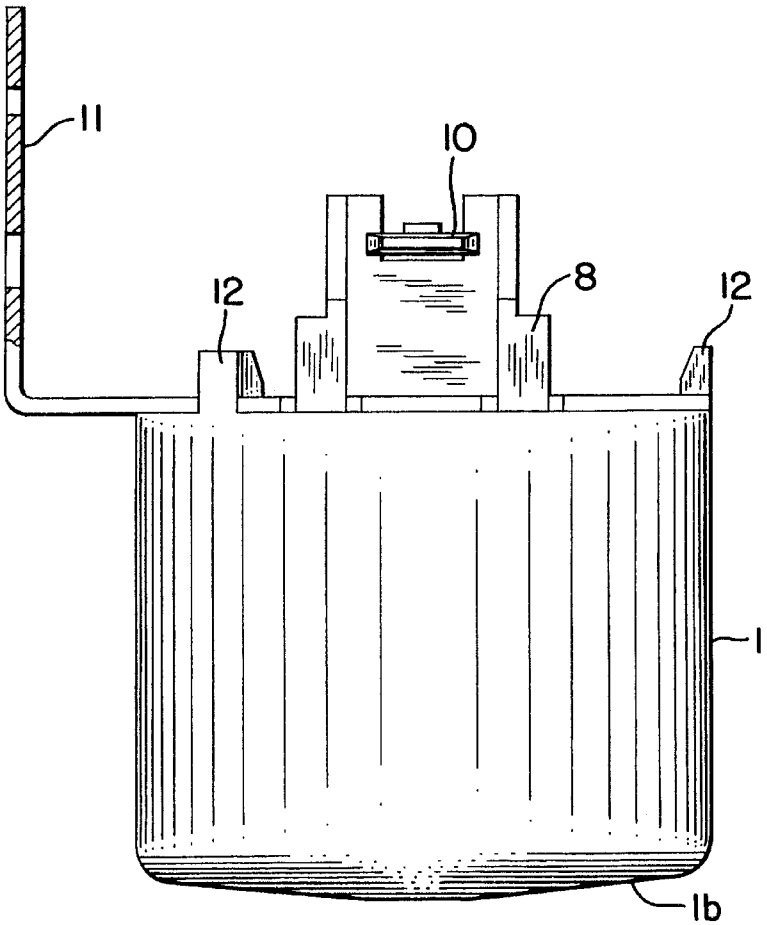
FIG. 4 shows a side view of the stabilizer of the invention according to FIG. 1.
Figure 3:
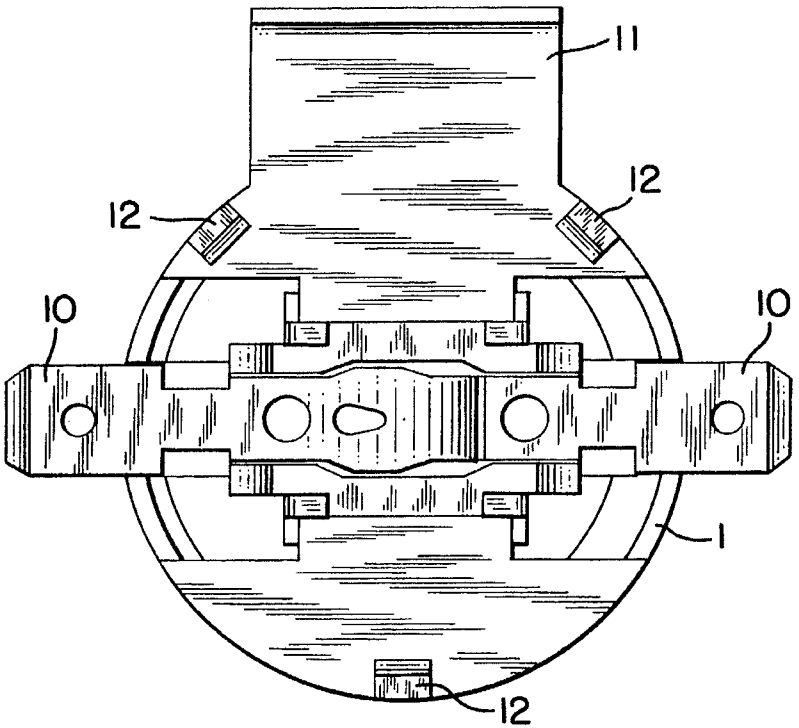
FIG. 3 shows a plan view of a stabilizer according to FIG. 1.

As results clearly from FIGS. 3 and 4 in particular, the cylindrically shaped housing 1 comprises at its upper cylinder jacket edge several detents 12 which in the stop location engage the superimposed housing cover 14 and fasten the latter in a snap-on fashion. As results further from FIGS. 3 and 4, the housing cover 14 additionally comprises a mounting element 11 extending from it at a right angle, which can be provided with borings or appropriate fastening grooves.

Figure 2:
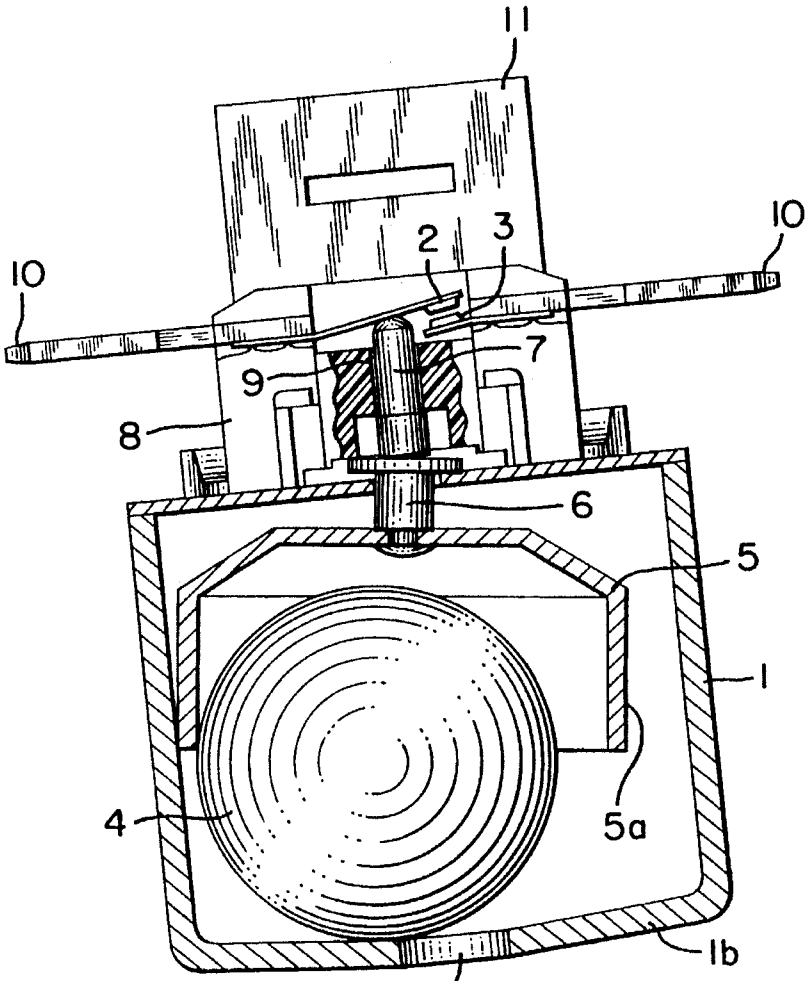
FIG. 2 shows a sectional side elevation according to FIG. 1, with the stabilizer in a tilting position.

When the stabilizer is tilted, as shown in FIG. 2, the ball moves laterally out of its stable equilibrium position, strikes against the shell jacket 5*a* of shell 5 and tilts the latter. The tilting motion is transferred by way of the control piston 6 to the cylindrical pin 7 and is to a certain extent transformed into a linear motion. The cylindrical pin 7, which preferably is made of an electrically insulating material, lifts the contact tongue 2 off the corresponding contact 3 and thereby opens the electric contact.

According to the invention, in a stabilizer with a housing, at least one switching device, and a control ball movably arranged in the housing to control a switching device, a shell is arranged to hang opposite the switching device, with the jacket of the shell in the rest position circumscribing the control ball at a distance, so that upon a tilting motion of the housing a sudden, complete switching of the switching device is assured.

The control ball is appropriately arranged resting stably in a central boring of an outwardly curved housing bottom. The boring can advantageously be shaped conically towards the inside of the housing. From a specific angle of tilt, which preferably is 5° to the perpendicular, the ball runs from its stable equilibrium position in the bottom of the housing and suddenly hits the shell jacket embracing it. The tilting of the shell jacket is in turn transferred to a switching device by way of a control piston and a linearly guided cylindrical pin. In particular, the shape of the boring provided centrally in the housing and the inclination of the housing bottom support a sudden, complete switching when the switching device is tilted.

In this connection it is also conceivable to actuate with the aid of the proposed stabilizer, not only electrical switching elements, but also pneumatic or hydraulic valves.

Various changes in practice and modifications in structure may evidently be introduced in the foregoing particularly disclosed and described embodiments and practices without departing from the invention. Thus, such embodiments and practices are intended in an illustrative and not in a limiting sense. The true spirit and scope of the invention is set forth in the ensuing claims.

What is claimed is:

1. A stabilized disconnection switch including a switching device, a housing, a control ball movably supported in the housing to control the switching device, a shell hangably supported by the housing opposite the switching device and noncontiguously circumscribing the control ball in a rest position of the stabilized disconnection switch, whereby, during a tilting motion of the housing, a sudden, complete switching of the switching device occurs upon movement of the shell upon contact of said control ball with said shell.

2. The stabilized disconnection switch claimed in claim 1, wherein said switching device comprises a pair of contacts, a pin member engaging one of said contacts and a control piston which is secured to said shell and engages said pin member, wherein said movement of said shell causes a tilting motion of the control piston and linear movement of said pin member and movement of said one contact.

3. The stabilized disconnection switch claimed in claim 1, wherein said tilting motion of said housing causing said switching of said switching device is not more than five degrees.

4. The stabilized disconnection switch claimed in claim 3, wherein said tilting motion of said housing causing said switching of said switching device is five degrees.

5. The stabilized disconnection switch claimed in claim 2, wherein said switching device comprises at least two electrical contacts arranged opposite each other, which in a rest position adjoin each other in electrical contact.

6. The stabilized disconnection switch claimed in claim 5, wherein said electrical contacts comprise contact springs.

7. The stabilized disconnection switch claimed in claim 2, wherein said housing has an upper flat surface with a central opening therein and wherein said control piston has an upper end portion seated on said flat surface across and beyond said central opening and a portion depending from said upper end portion and seated in said central opening.

8. The stabilized disconnection switch claimed in claim 1, wherein said housing has an outwardly curved housing bottom with a central boring shaped conically towards the inside of the housing.

9. The stabilized disconnection switch claimed in claim 1, wherein said housing includes a cylindrical body with spring members upwardly thereon, said spring members releasably securing a cover to said housing.

10. The stabilized disconnection switch claimed in claim 1, wherein said housing is comprised of a plastic material.

11. The stabilized disconnection switch claimed in claim 1 further including a mount for said housing, said mount being comprised of an electrically insulating material.

12. The stabilized disconnection switch claimed in claim 11, wherein said mount is comprised of a ceramic material.

* * * * *

UNITED STATES PATENT AND TRADEMARK OFFICE

CERTIFICATE OF CORRECTION

PATENT NO. : 5,477,019

DATED : December 19, 1995

INVENTOR(S) : Klaus Dolling

It is certified that error appears in the above-identified patent and that said Letters Patent is hereby corrected as shown below:

Col. 1, line 9, change "stabilizer for switches" to -- stabilized switch for --.

Col. 1, line 22, after "a" insert -- stabilized --.

Col. 1, line 24, delete "which serves as a stabilizer".

Col. 1, line 42, change "stabilizer" to -- stabilized disconnection switch --.

Col. 1, line 47, change "stabilizer" to -- tipping element --.

Col. 1, line 63, change "stabilizer" to -- stabilized disconnection switch --.

Col. 2, line 4, change "stabilizer" to -- stabilized disconnection switch --.

Col. 2, line 7, change "stabilizer" to -- stabilized disconnection switch --.

Col. 2, line 23, change "stabilizer" to -- stabilized disconnection switch --.

Col. 2, line 26, change "stabilizer" to -- stabilized disconnection switch --.

Col. 2, line 27, change "stabilizer" to -- stabilized disconnection switch --.

Col. 2, line 29, change "stabilizer" to -- stabilized disconnection switch --.

UNITED STATES PATENT AND TRADEMARK OFFICE

CERTIFICATE OF CORRECTION

PATENT NO. : 5,477,019 Page 2 of 2

DATED : December 19, 1995

INVENTOR(S) : Klaus Dolling

It is certified that error appears in the above-identified patent and that said Letters Patent is hereby corrected as shown below:

Col. 2, line 35, change "stabilizer" to -- stabilized disconnection switch --.

Col. 2, line 61, change "stabilizer" to -- stabilized disconnection switch --.

Col. 3, line 3, change "stabilizer" to -- stabilized disconnection switch --.

Col. 3, line 25, change "stabilizer" to -- stabilized disconnection switch --.

Signed and Sealed this

Twentieth Day of August, 1996

*Attest:*

Bruce Lehman

BRUCE LEHMAN

*Attesting Officer*

*Commissioner of Patents and Trademarks*